US006916220B2

(12) United States Patent
Davey et al.

(10) Patent No.: US 6,916,220 B2
(45) Date of Patent: Jul. 12, 2005

(54) REMOVABLE FIN SYSTEM

(75) Inventors: Graeme Davey, Avalon (AU); Jim Banks, Byron Bay (AU); Derek Harper, Yelgan (AU)

(73) Assignee: Low Pressure Systems PTY, Ltd. (AU)

( * ) Notice: Subject to any disclaimer, the term of this patent is extended or adjusted under 35 U.S.C. 154(b) by 0 days.

(21) Appl. No.: 10/239,475

(22) PCT Filed: Feb. 19, 2001

(86) PCT No.: PCT/AU01/00169

§ 371 (c)(1),
(2), (4) Date: Jul. 28, 2003

(87) PCT Pub. No.: WO01/70565

PCT Pub. Date: Sep. 27, 2001

(65) Prior Publication Data

US 2004/0035346 A1 Feb. 26, 2004

(Under 37 CFR 1.47)

(30) Foreign Application Priority Data

Mar. 22, 2000 (AU) ..... PQ6377

(51) Int. Cl.[7] ..... B63B 1/28; B63B 39/06

(52) U.S. Cl. ..... 441/79; 114/39.15; 114/127; 114/136

(58) Field of Search ..... 441/79, 74; 114/152, 114/39.12, 39.15, 126–140, 143

(56) References Cited

U.S. PATENT DOCUMENTS

| | | | | | |
|---|---|---|---|---|---|
| 3,422,471 | A | * | 1/1969 | Morey et al. | 441/74 |
| 3,585,663 | A | * | 6/1971 | Johnson | 441/79 |
| 3,965,514 | A | * | 6/1976 | Shafer et al. | 441/79 |
| 4,044,416 | A | * | 8/1977 | Brewer et al. | 441/79 |
| 4,352,335 | A | * | 10/1982 | Sugden | 114/143 |
| 4,379,703 | A | * | 4/1983 | Mizell | 441/79 |
| 4,421,492 | A | * | 12/1983 | Leva | 441/79 |
| 4,811,674 | A | * | 3/1989 | Stewart | 441/79 |
| 4,854,904 | A | * | 8/1989 | Wahl | 441/79 |
| 4,904,215 | A | * | 2/1990 | Sherwood | 441/79 |
| 5,215,488 | A | * | 6/1993 | Bailey | 441/79 |
| 5,503,581 | A | * | 4/1996 | McCullough | 441/79 |
| 5,649,846 | A | * | 7/1997 | Harper et al. | 441/79 |

(Continued)

FOREIGN PATENT DOCUMENTS

| | | | | |
|---|---|---|---|---|
| AU | 665804 | | 9/1993 | |
| AU | 693962 | | 7/1996 | |
| AU | 718340 | | 4/1998 | |
| EP | 88430 | A * | 9/1983 | B63B/35/82 |
| FR | 2510968 | A * | 2/1983 | B63B/35/72 |
| FR | 2659931 | A * | 9/1991 | B63B/39/06 |
| JP | 03208793 | A * | 9/1991 | B63B/41/00 |
| WO | WO 9013472 | A1 * | 11/1990 | B63B/35/79 |
| WO | WO 9117080 | A1 * | 11/1991 | B63B/35/79 |

*Primary Examiner*—S. Joseph Morano
*Assistant Examiner*—Ajay Vasudeva
(74) *Attorney, Agent, or Firm*—Robert C. Kowert; Meyertons, Hood, Kivlin, Kowert & Goetzel, P.C.

(57) ABSTRACT

A pivotal fin system, for use with an aquafoil, such as surfboards, body boards, wave skis, sail boards, wake boards and the like, comprising a pot (3) and a fin (2), having a tab (18) extending from the base (17) of the fin (2). The pot (3) has a central slot (11) and is mounted in the board (23) with the opening of the central slot (11) flush with the board (23). The slot (11) has a releasable locking means (6 & 7) therein, and the tab (18) has a connection means (21 & 22), which is releasably engaged by locking means (6 & 7). Preferably the releasable locking means (6 & 7) is a substantially c-shaped clamp, and the connection means (21 & 22) has a recess or recesses (22) behind a bulbous extension (21), which is engaged in the c-shaped clamp, with arms (5) of the c-shaped clamp engaging in the recess or recesses (22).

20 Claims, 8 Drawing Sheets

U.S. PATENT DOCUMENTS 5,809,926 A * 9/1998 Kelsey ..... 114/274
5,813,890 A * 9/1998 Benham ..... 441/79
5,830,025 A * 11/1998 Fleming ..... 441/79
5,934,962 A * 8/1999 Daum et al. ..... 441/79
5,934,963 A * 8/1999 Frizzell ..... 441/79
5,997,376 A * 12/1999 Block et al. ..... 441/79
6,068,531 A * 5/2000 Patterson ..... 441/74
6,139,383 A * 10/2000 Jolly et al. ..... 441/74
6,244,921 B1 * 6/2001 Pope ..... 441/79
6,386,933 B1 * 5/2002 Rewald et al. ..... 441/74
6,752,674 B2 * 6/2004 Jolly ..... 441/79
6,821,173 B2 * 11/2004 McCausland et al. ..... 441/79
2003/0124924 A1 * 7/2003 McCausland et al. ..... 441/79

* cited by examiner 2
22
18
11
6
6
3
5
21
7
1

REMOVABLE FIN SYSTEM

BACKGROUND OF THE INVENTION

1. Field of the Invention

The present invention relates to a removable fin system, and in particularly to removable fin system for an aquafoil, such as surfboards, body boards, wave skis, sail boards, wake boards and the like.

2. Background and Prior Art

It is known to produce a releasable fin for surfboards and the like, such that the fin can be replaced if damaged, or conditions of the water changes, e.g. different wave conditions. In the prior art, such as Australian patent no. 665804, some of the replaceable fins are affixed to the boards by screws, which requires tools to remove and replace the fin, or by a cam, as in Australian patent 718340. In other situations the replaceable fins have a tab, which fits into a slot cut into the board and has backwardly facing barbed sides, which lock into the core of the board to resist removal.

Another prior art replaceable fin is shown in Australian Patent no. 693962, in which the replaceable fin system has a pot fitted into the board. The pot has a central slot with reversed tapered walls flaring from its opening to its base within the board. The fin has a tab portion to fit into the central slot. The tab has tapered sides, complementary to the flared central slot, which at least one vertically longitudinally extending cutout in the tab to form wings, which are forced together to allow the tab to fit within the slot opening.

Whilst this system is acceptable, it has been found that the reverse taper on the wings of the tab, allows the tab to wiggle partway out of the slot in certain conditions of high stress, which greatly reduces the efficiency of the fin.

SUMMARY OF THE INVENTION

The present invention seeks to ameliorate the above disadvantages by providing a replaceable fin system for an aquafoil, such as surfboards, body boards, wave skis, sail boards, wake boards and the like, comprising:

a pot having a slot therein, and adapted to be fitted into the surface of the aquafoil;

a first connection means extending into said slot;

a fin having a tab which fits within said slot, and a second connection means located on said tab, which releaseably engages with said first connection means to retain said tab in said slot.

In one embodiment the wall or walls of the slot are substantially parallel

In another form, the invention comprises a replaceable fin system for an aquafoil, such as surfboards, body boards, wave skis, sail boards, wake boards and the like, comprising:

a pot having a slot, therein, and adapted to be fitted into the surface of the aquafoil;

a fin having a leading edge, a trailing edge, a bottom surface and a tab extending from the bottom surface away from the fin and extending along the bottom surface from the leading edge to a point intermediate the leading and trailing edges of the fin, said tab fitting within said slot; and a connection means located on said tab, which releaseably engages in said slot.

In one embodiment, the second connection means is formed integrally with said pot.

In a further embodiment, the second connection means fits into the base of the slot where it is held against the base of the pot.

In a further form the invention comprise a method of inserting a pot for a replaceable fin system for an aquafoil, such as surfboards, body boards, wave skis, sail boards, wake boards and the like, as described before comprising the steps of:

marking aligning points on the aquafoil, for the fin position;

positioning a first jig having registration points and a central cutout, such that the registration points align with the registration markers on the aquafoil and securing said first jig in position;

routing out a cavity bounded by the periphery of the central cavity of the first jig;

attaching one of said pots to a setup jig and positioning said setup jig on said first jig such that said pot is positioned within said cavity;

introducing a setting compound into said cavity around said pot and allowing said setting compound to set to secure said pot in said cavity; and removing said setup jig from said pot.

Preferably the setting compound is a resin.

Preferably the registration markers are cross hair lines, and the opening of the pot cavity is bevelled.

BRIEF DESCRIPTION OF THE DRAWINGS

The present invention will now be described with reference to the accompanying drawings in which.

DETAILED DESCRIPTION OF THE PREFERRED EMBODIMENTS

Figure 1:
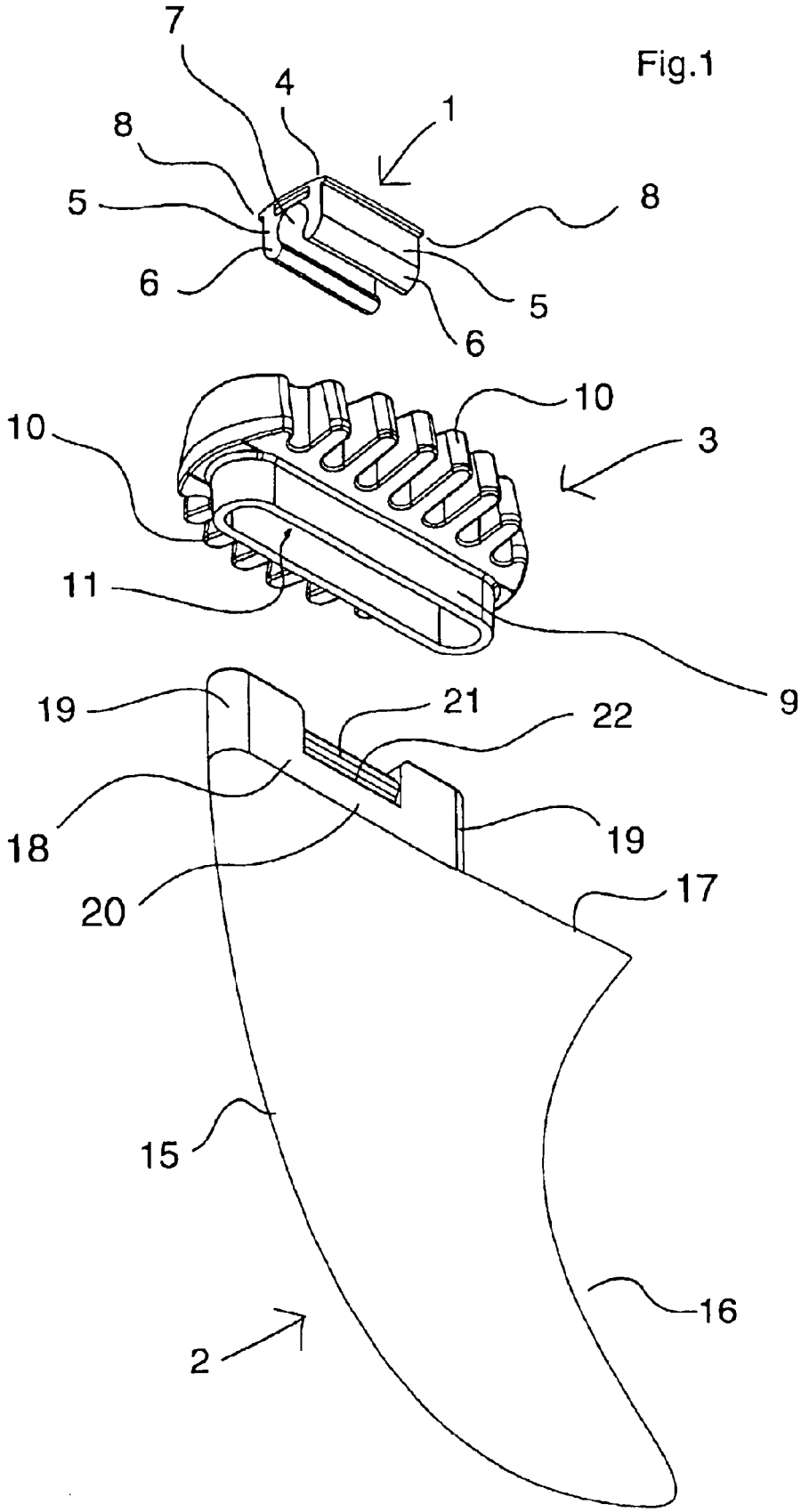
FIG. 1 illustrates a bottom exploded perspective view of a fin system according to one embodiment of the present invention.
Figure 2:
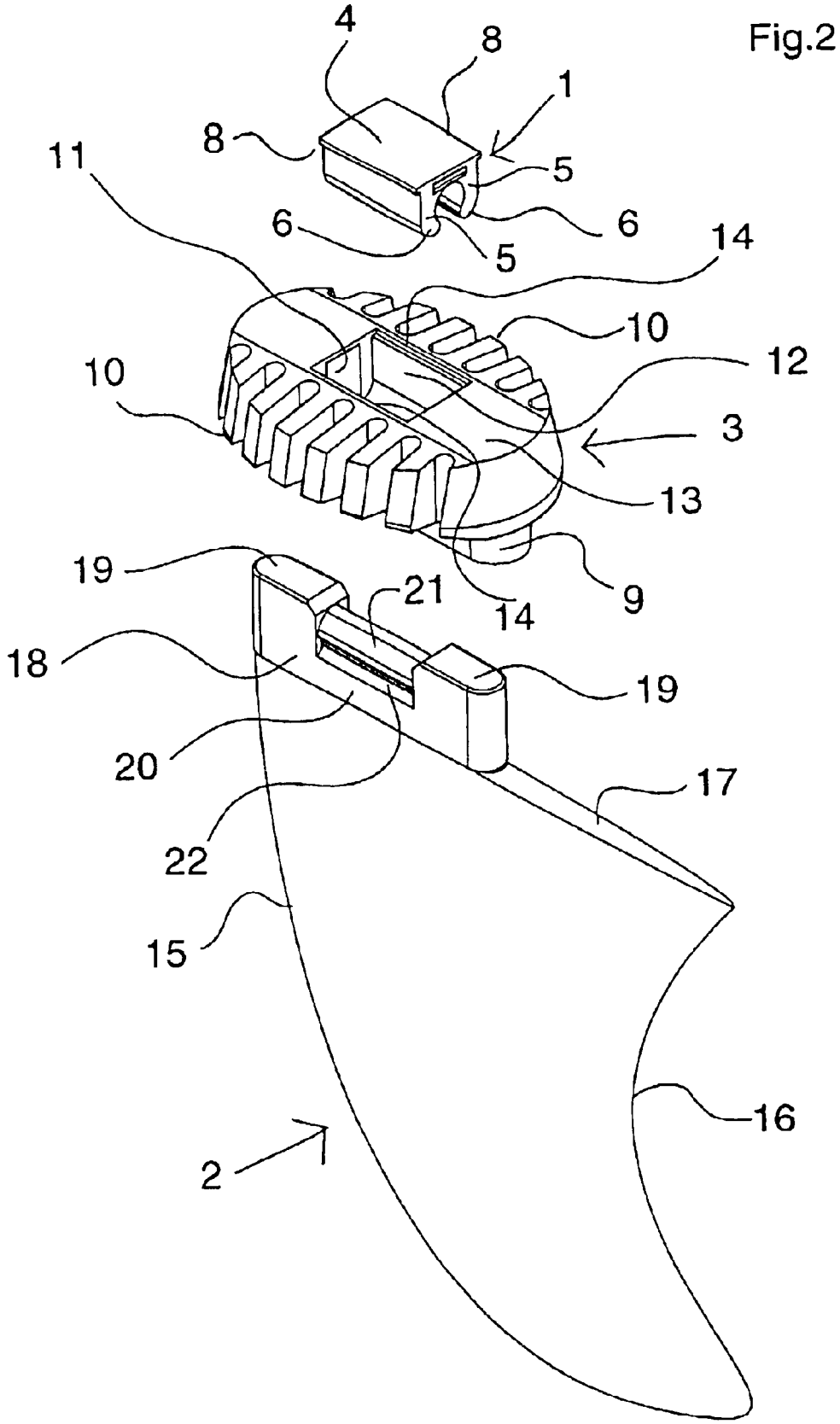
FIG. 2 illustrates a top exploded perspective view of the fin system show in FIG. 1.
Figure 3:
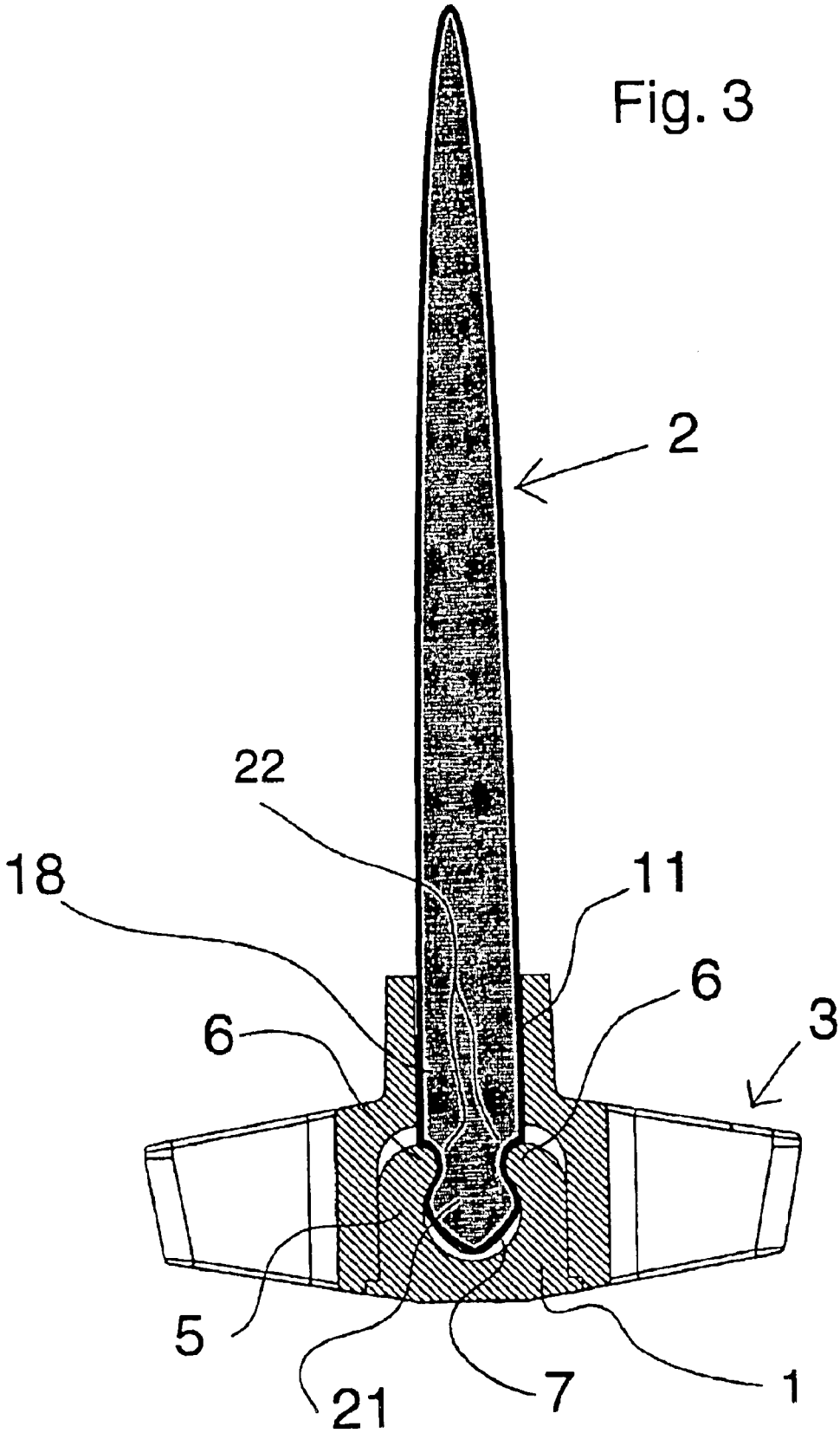
FIG. 3 illustrates a sectional view of the fin system according to FIGS. 1 & 2, with the components connected.

As shown in FIGS. 1, 2 and 3, a replaceable fin system according to one embodiment of the present invention comprises a clip (1), a fin (2) and a pot (3). The clip (1) comprises a base (4) having two arms (5), terminating in free ends (6), forming a c-shaped cavity (7) therebetween. The clip (1) also has two shoulders (8) extending outwardly from the base (4) beyond the arms (5).

The pot (3) comprises a central body (9) having an array of outwardly extending wings (10) on each side thereof. A longitudinally extending closed slot (11) extends into the central body (9) and a cutout (12) is formed in the base (13) of the pot (3) to receive the clip (1). Whereby the clip (1) extends into the slot (11) with the shoulders (8) of the clip (1) abutting against the recessed shoulders (14) of the cutout (12).

The fin (2) comprises a leading edge (15), a trailing edge (16) and a base (17), with a tab (18) extending therefrom. In the described embodiment, the tab (18) starts at the leading edge (15) of fin and extends along the base (17) to approximately mid point of the base (17). The tab (18) has two end portions (19), which are of substantially the same width as the width of the slot (11) and has an intermediate section (20) an outer rail (21) with two recesses (22) located behind the rail (21).

Therefore when the clip (1) is in position in said cutout (12), and the tab (18) of the fin (2) is pushed into the slot (11), the rail (21) forces the free ends (6) of the arms (5) of the clip (1) apart and mates in the c-shaped cavity (7) of clip (1), with the free ends (6) of the arms (5) engaging behind the rail (21) in the recesses (22), as shown in FIG. 3, to exert vertical pressure on the rail (21), drawing the fin (2) downwardly into the slot (11). In one embodiment, the arms (5) provide a first connection means and the rail (21) provides a second connection means.

The fin system can be affixed to board as shown in FIGS. 4 to 8, wherein the pot (3) and clip (1) are embedded in the board (23).

Figure 4:
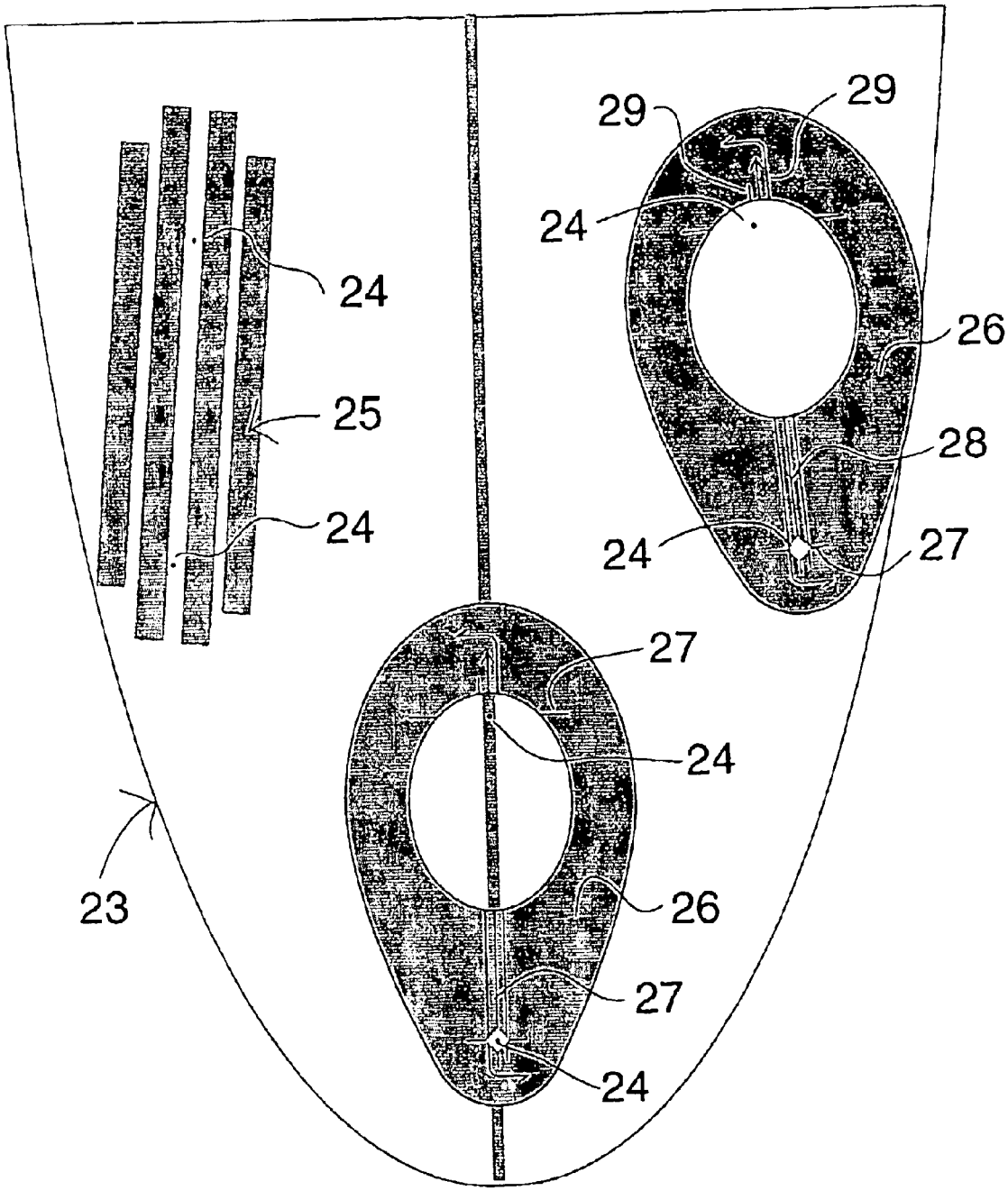
FIG. 4 illustrates schematically, stages in aligning the first jig on the surfboard.

As shown in FIG. 4, two reference points (24) are marked on the board (23) for each fin (2) position. A suitable adhesive in the case a double sided adhesive tape (25) is applied to the board (23). The jig (26) is positioned on the adhesive by aligning the respective reference lines (27) with the reference points (24) on the board. (23). With the back central fin the middle cross hairs (28) are used to align with the reference points (24), while with the forward angled fins the respective inside cross hairs (29) are used to align with the reference points (24).

The jig (26) is then secured by the adhesive tape (25) and a router is used to follow the periphery of the central opening (30) of the jig (26) to form a cavity (31) in the board (23) to receive the pot (3). Preferably the edges of the cavity are bevelled or under cut.

Figure 5:
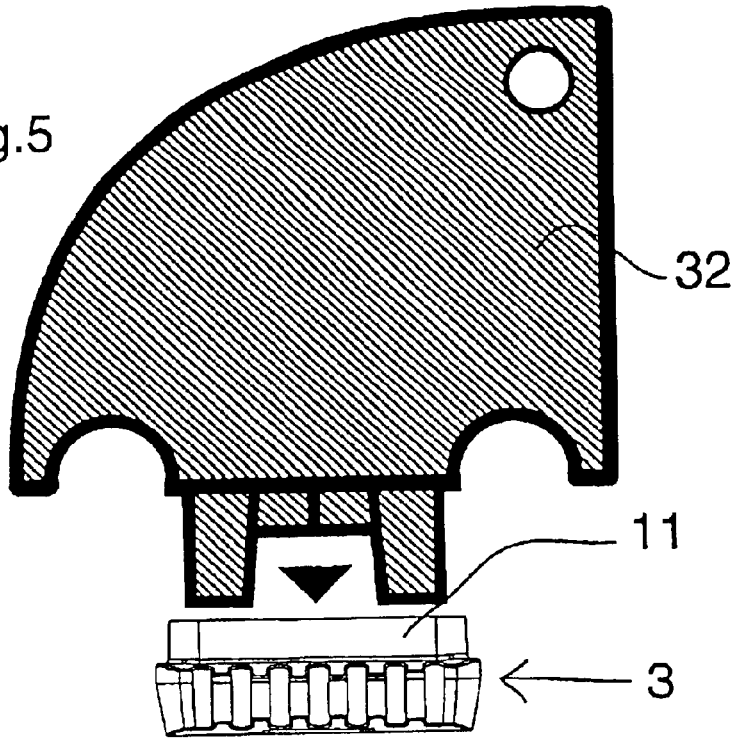
FIG. 5 illustrates the stage of affixing the setup jig to a pot of the fin system as shown in FIGS. 1 to 3 of the accompanying drawings.
Figure 6:
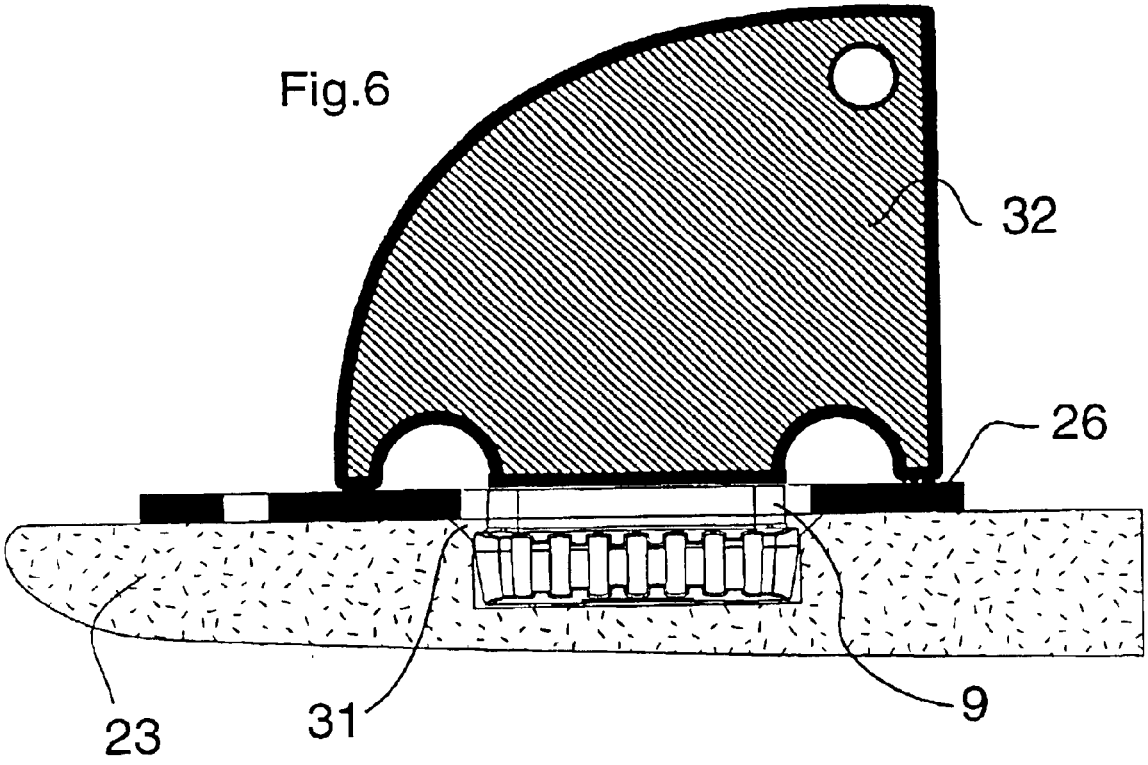
FIG. 6 illustrates schematically the positioning of the pot of the fin system as shown in FIGS. 1 to 3 of the accompanying drawings into the board cavity.

As shown in FIG. 5, a set up jig (32) is inserted into the slot (11) and the pot (3) placed in the cavity (31) in the board (23), with the set up jig (32) resting upon the jig (26), with part of the central body (9) standing proud of the cavity (31). A suitable setting compound, such as a resin mixture, is poured to fill the cavity (31) around the pot (3). The resin is allowed to cure for a suitable time, and the set up jig (32) and the jig (26) are removed.

Figure 7:
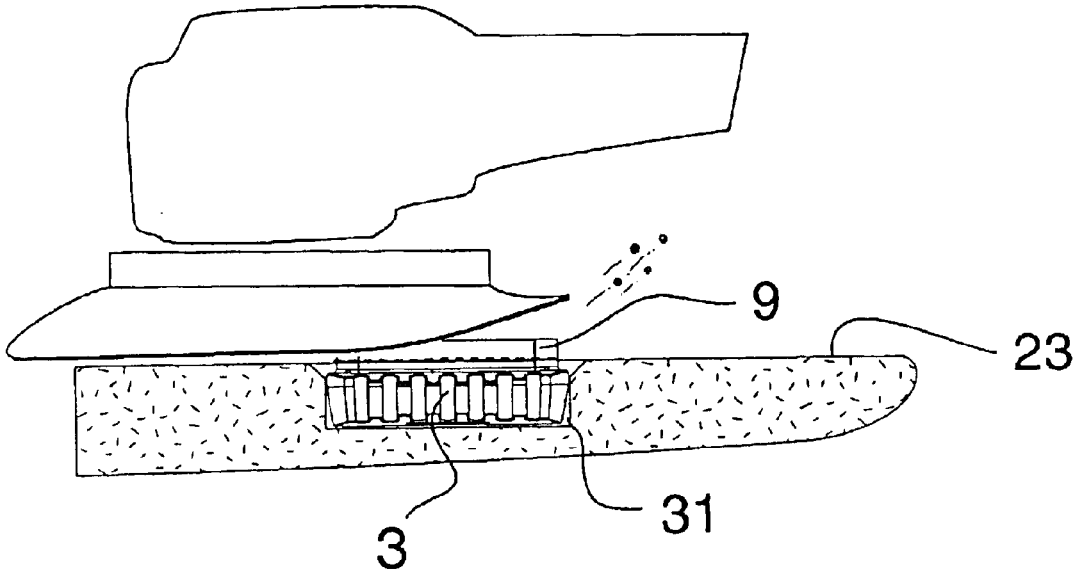
FIG. 7 illustrates schematically a further stage in affixing the pot of the fin system as shown in FIGS. 1 to 3 of the accompanying drawings into the board cavity.
Figure 8:
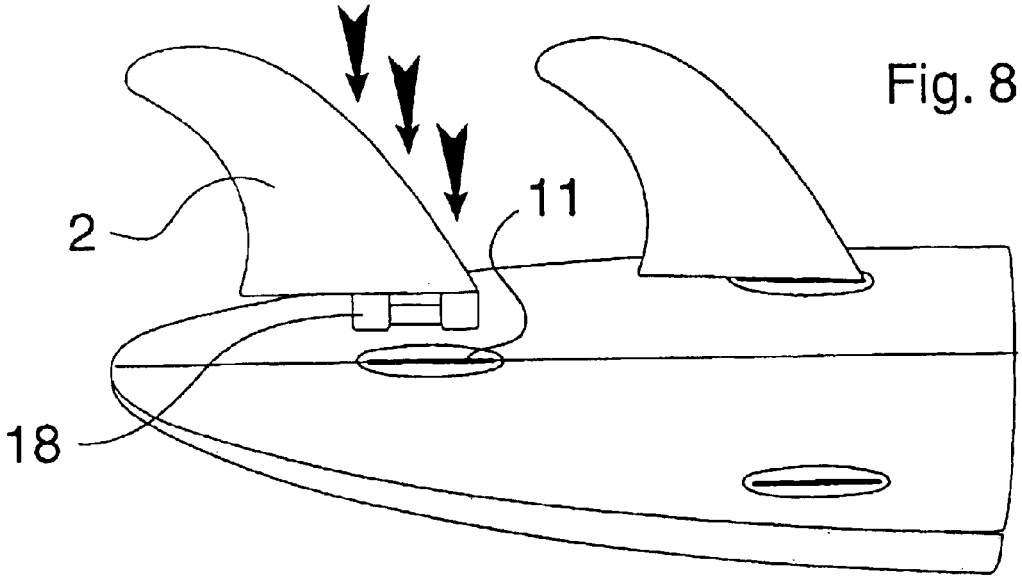
FIG. 8 illustrates schematically the affixing of a fin into the fin system according to the embodiment shown in FIGS. 1 to 3 of the accompanying drawings.

Then as shown in FIG. 7, the central body (9) of the pot (3), standing proud of the cavity (31) and any additional resin is sanded away, to a smooth finish, leaving the slot (11) substantially flush with the surface of the board (23). The fin (2) is simple affixed to the board (23) by pushing the tab (18) into the slot (11), where the tab (18) locks into the clip (1) as described previously.

In the prior art, fins have a tab adjacent each end of the base, or a full length tab, both of which prevents pivoting of the trailing edge of the fin, or as shown in Australian Patent no. 693962, a centrally located tab, which does not allow for full pivoting of the trailing edge of the fin. In the embodiments of the present invention, by positioning the tab (18) at the leading edge (15) of the fin (2) and having it finish at approximately the mid point of the base (17) of the fin (2), the trailing edge is free of the board (23), and can pivot, to a greater degree, under the hydraulic forces to reduce drag and cavitation and increase the power of the fin (2). However the tab (18) can finish any suitable distance along the fin provided that the tab starts at the leading edge (15) of the fin (2).

Figure 9:
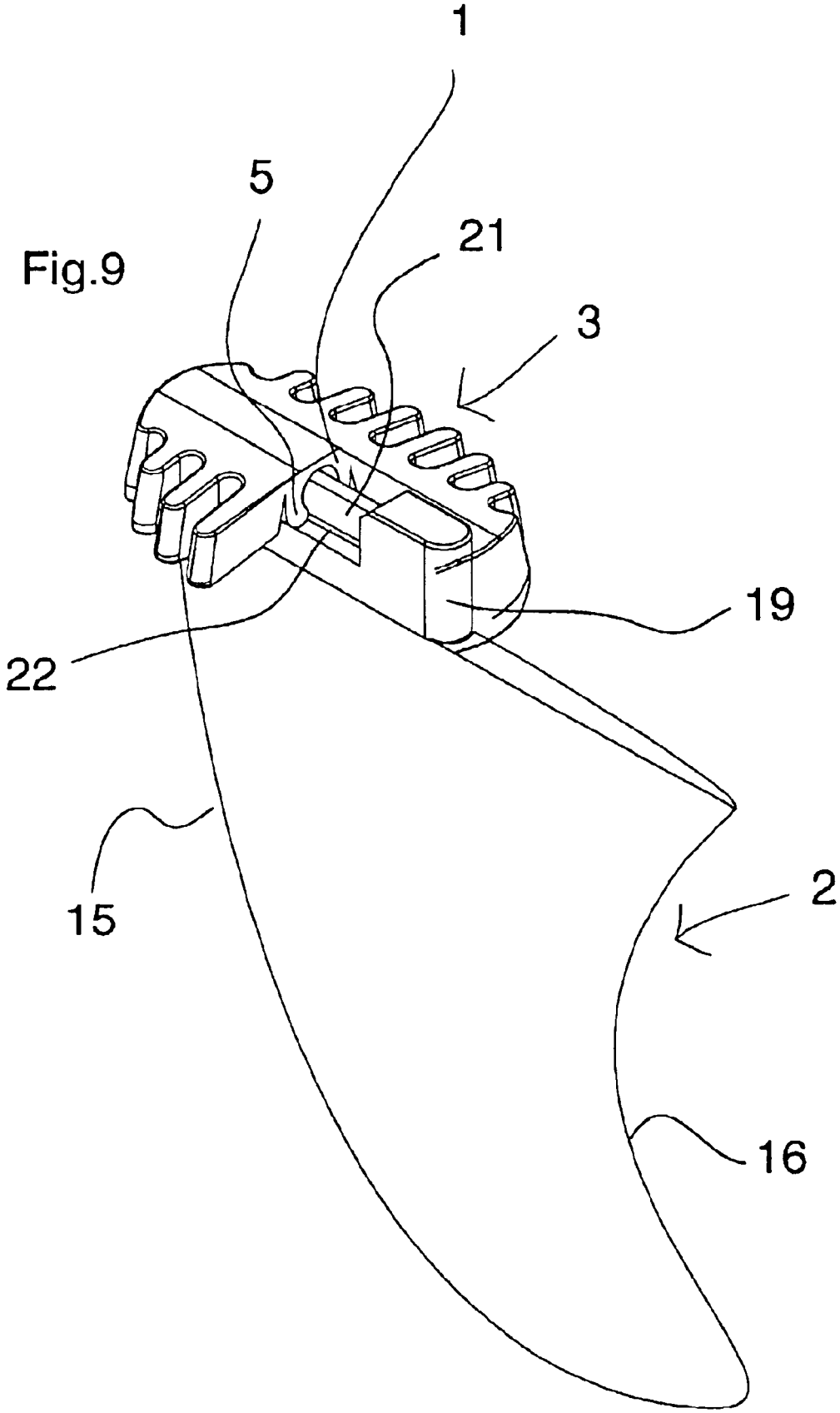
FIG. 9 illustrates a top exploded perspective view of a fin system according to another embodiment of the present invention, with a cut away view of the pot.
Figure 10:
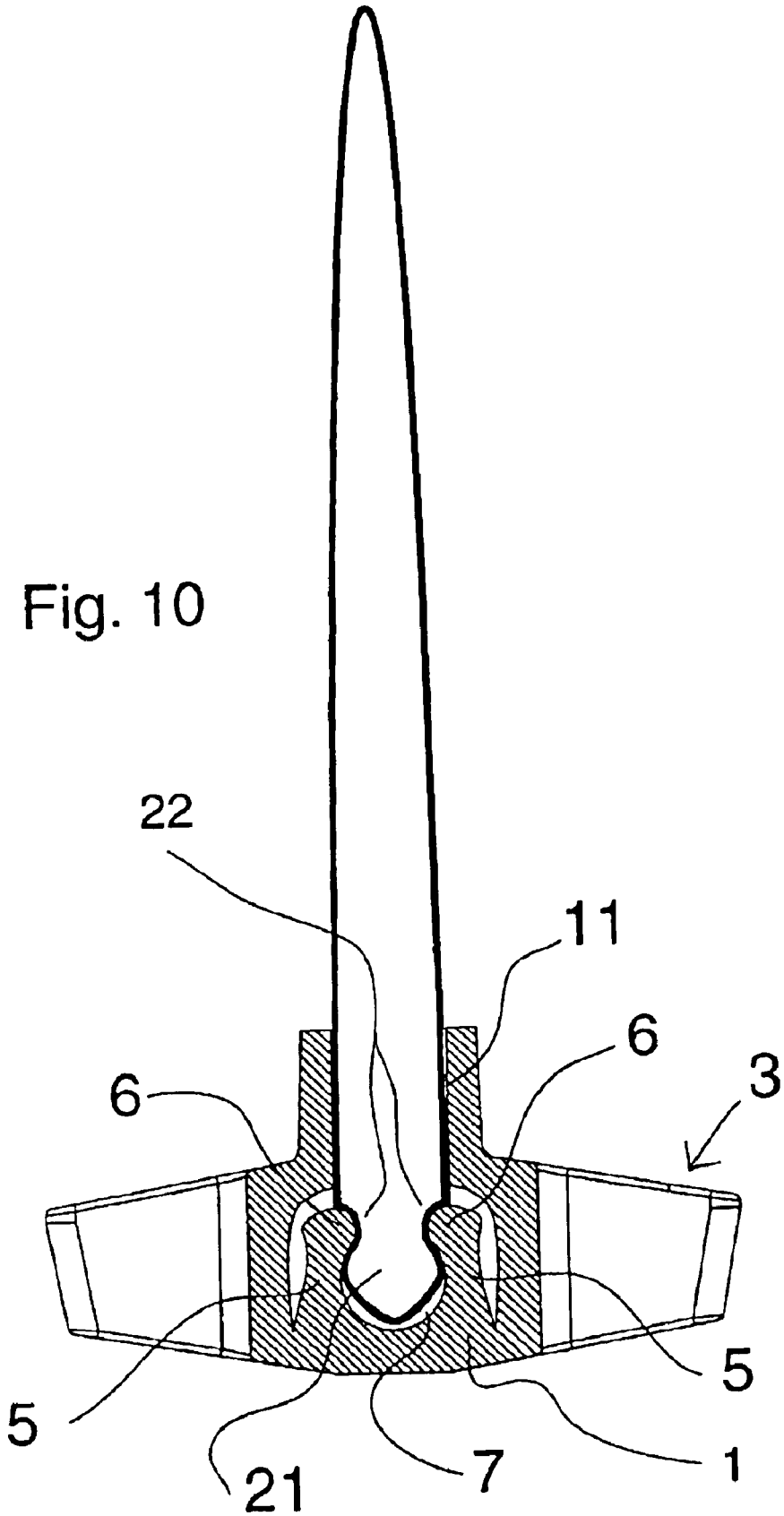
FIG. 10 illustrates a sectional view of the fin system according to FIG. 9, with the components connected.

A further embodiment of the fin system is shown in FIGS. 9 & 10 in which the pot (3) has locking arms (5), which operate in the same manner to engage the rail (21) and engage in the recesses (22) as the arms (5) of the clip (1) described previously.

Further the shape of the rail and the form of the arms and the respective recesses can be any suitable shape. Further any suitable male and female connections involving a positive locking fit as compared to a frictional fit can be used to connect the tab of the fin in the slot of the pot. Further the male component could be in the slot with the female component on the fin.

The pot can be made of any suitable polymer material, such as polycarbonate with a 20% glass fill; the clip could be made from any suitable polymer, such as nylon 66, acetyl or polyethylene or polypropylene or an elastomer; the fin could be made from any suitable material.

It should be obvious to people skilled in the art that alterations and modifications could be made to the above described embodiment without departing from the scope and the spirit of the present invention.

The claims defining the invention are:

1. A replaceable fin system for an aquafoil, comprising:

a pot having a slot therein and adapted to be fitted into the surface of the aquafoil;

a first connection means extending into said slot;

a fin having a leading edge, a trailing edge, a base, a tab extending from the base away from the fin and adapted to fit within said slot, said tab extending along the base of the fin from adjacent the leading edge to end at a point intermediate the leading and trailing edges, wherein a portion of the fin adjacent the trailing edge is adapted to remain free of the acquafoil to pivot dynamically in response to differing conditions; and a second connection means located on said tab, which releasably engages with said first connection means to retain said tab in said slot wherein said first connection means comprises two opposed arms, and the second connection means comprises a bulbous projection located on a neck of the tab and the two arms engage the neck behind the bulbous projection to abut against the bulbous projection to resist the vertical movement of the fin out of the slot, wherein the arms extend longitudinally along the slot and form a substantially c-shaped clamp in cross section and the bulbous projection is a rail extending longitudinally along the tab, with the neck being a longitudinally extending recess or recesses located between the rail and the base of the fin.

2. A fin system according to claim 1 wherein the slot has its wall or walls substantially parallel.

3. A fin system according to claim 1, wherein the first connection means is formed integrally with said pot.

4. A fin system according to claim 1, wherein the first connection means fits into a cutout in the base of the pot where it is held against the base of the pot and extends into the slot.

5. A fin system according to claim 1, wherein the rail and the recess or recesses are located intermediate two end portions of the tab, which are of substantially the same width as the width of the slot.

6. A replaceable fin system for an aquafoil, comprising:

a pot having a body, having a top, a base with an opening therein and an array of sideway extending wings, a slot in the body open to the top, said pot being adapted to be fitted into the surface of the aquafoil;

a clip adapted to be located in a cutout in the base of the body, where the clip is held against the base of the pot and extends into said slot; said clip having two opposed arms, extending longitudinally along the slot, which form a substantially c-shaped clamp in cross section, with a substantially cylindrical central cavity;

a fin having a leading edge, a trailing edge, a base, a tab extending from the base away from the fin and being adapted to fit within said slot, said tab extending along the base of the fin from adjacent the leading edge to a point intermediate the leading and trailing edges; and a rail extending longitudinally along at least the central portion of the tab, with a recess or recesses located between the rail and the base of the fin, wherein when said tab is pushed into said slot, the two arms of the clip are forced aside and lock into the recesses or recess holding the rail within the substantially cylindrical central cavity of the c-shaped clamp, to resist the movement of the fin out of the slot.

7. A fin system according to claim 6 wherein the slot has its wall or walls substantially parallel.

8. A fin system according to claim 7 wherein the rail and the recess is located intermediate two end portions of the tab which are of substantially the same width as the width of the slot.

9. A fin system according to claim 6 wherein the tab extends along the bottom surface of the fin from the leading edge to approximately the mid point between the leading and trailing edges of the fin.

10. A replaceable fin system for an aquafoil, comprising:

a pot having a body, having a top, a base with an opening therein and an array of sideway extending wings, a slot in the body open to the top, said pot being adapted to be fitted into the surface of the aquafoil;

a clip adapted to be located in a cutout in the base of the body, where the clip is held against the base of the pot and extends into said slot, said clip having two opposed arms, extending longitudinally along the slot, which form a substantially c-shaped clamp in cross section, with a substantially cylindrical central cavity;

a fin having a leading edge, a trailing edge, a base, a tab extending from the base away from the fin, said tab being adapted to fit within said slot; and a rail extending longitudinally along at least the central portion of the tab, with a recess or recesses located between the rail and the base of the fin, wherein when said tab is pushed into said slot, the two arms of the clip are forced aside and lock into the recesses or recess holding the rail within the substantially cylindrical central cavity of the c-shaped clamp, to resist the movement of the fin out of the slot and thereby releasably retain the fin to the aquafoil without threaded or additional fastening means.

11. A fin system according to claim 10 wherein the slot has its wall or walls substantially parallel.

12. A fin system according to claim 11 wherein the rail and the recess is located intermediate two end portions of the tab which are of substantially the same width as the width of the slot.

13. A fin system according to claim 10 wherein the tab extends along the bottom surface of the fin from the leading edge to a point intermediate the leading and trailing edges of the fin.

14. A fin system according to claim 10 wherein the tab extends along the bottom surface of the fin from the leading edge to approximately the mid point between the leading and trailing edges of the fin.

15. A replaceable fin system for an aquafoil, comprising:

a pot having a slot therein and adapted to be fitted into the surface of the aquafoil;

a first connection means extending into said slot;

a fin having a leading edge, a trailing edge, a base, a tab extending from the base away from the fin and adapted to fit within said slot, said tab extending along the base of the fin from adjacent the leading edge to end at a point intermediate the leading and trailing edges; and a second connection means located on said tab, which releasably engages with said first connection means to retain said tab in said slot;

wherein said first connection means comprises two opposed arms, and the second connection means comprises a bulbous projection located on a neck of the tab and the two arms engage the neck behind the bulbous projection to abut against the bulbous projection to resist the vertical movement of the fin out of the slot, wherein the arms extend longitudinally along the slot and form a substantially c-shaped clamp in cross section and the bulbous projection is a rail extending longitudinally along the tab, with the neck being a longitudinally extending recess or recesses located between the rail and the base of the fin.

16. A fin system according to claim 15, wherein the rail and the recess or recesses are located intermediate two end portions of the tab, which are of substantially the same width as the width of the slot.

17. A method of installing a pot for a replaceable fin system according to any one of the previous claims, the method comprising the steps of:

marking aligning points on the aquafoil, for the fin position;

positioning a first jig having registration markings and a central cutout, such that the registration markings align with the registration points on the aquafoil and securing said first jig in position;

routing out a cavity bounded by the periphery of the central cutout of the first jig;

attaching one of said pots to a set up jig and positioning said setup jig on said first jig such that said pot is positioned within said cavity;

introducing a setting compound into said cavity around said pot an allowing said setting compound to set to secure said pot in said cavity; and removing said setup jig from said pot.

18. A method of inserting a pot for a replaceable fin system according to claim 17, wherein the registration markers are cross hair lines.

19. A method of inserting a pot for a replaceable fin system according to claim 17, wherein the opening of the pot cavity is bevelled.

20. A method of inserting a pot for a replaceable fin system according to claim 17, wherein the setting compound is a resin.

* * * * *